US008722296B2

(12) United States Patent
Mizutani et al.

(10) Patent No.: US 8,722,296 B2
(45) Date of Patent: May 13, 2014

(54) TONER FOR ELECTROSTATIC IMAGE DEVELOPMENT, METHOD OF PRODUCING THE SAME, ELECTROSTATIC IMAGE DEVELOPER, TONER CARTRIDGE, PROCESS CARTRIDGE, AND IMAGE FORMING APPARATUS

(75) Inventors: Noriyuki Mizutani, Kanagawa (JP); Shinya Nakashima, Kanagawa (JP); Takeshi Iwanaga, Kanagawa (JP); Takafumi Koide, Kanagawa (JP); Susumu Yoshino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 895 days.

(21) Appl. No.: 11/798,739

(22) Filed: May 16, 2007

(65) Prior Publication Data

US 2008/0131802 A1 Jun. 5, 2008

(30) Foreign Application Priority Data

Dec. 4, 2006 (JP) ..... 2006-326889

(51) Int. Cl.
*G03G 9/00* (2006.01)

(52) U.S. Cl.
USPC ..... 430/109.4; 430/137.14

(58) Field of Classification Search
USPC ..... 430/109.4, 137.14; 399/222
See application file for complete search history.

(56) References Cited

U.S. PATENT DOCUMENTS

| | | | | |
|---|---|---|---|---|
| 2002/0037467 | A1 | 3/2002 | Watanabe et al. | |
| 2003/0104296 | A1* | 6/2003 | Hamano et al. | 430/107.1 |
| 2004/0152813 | A1 | 8/2004 | Shirai | |
| 2005/0214670 | A1* | 9/2005 | Matsumoto et al. | 430/109.4 |
| 2005/0227157 | A1 | 10/2005 | Shirai | |
| 2005/0245694 | A1* | 11/2005 | Matsumura et al. | 525/437 |
| 2006/0057486 | A1 | 3/2006 | Moriyama et al. | |
| 2006/0204880 | A1* | 9/2006 | Mizutani et al. | 430/109.4 |
| 2007/0207401 | A1 | 9/2007 | Shirai | |

FOREIGN PATENT DOCUMENTS

| | | |
|---|---|---|
| JP | B2-62-039428 | 8/1987 |
| JP | A-2002-82488 | 3/2002 |
| JP | A-2003-270852 | 9/2003 |
| JP | A-2004-226847 | 8/2004 |
| JP | A-2005-099079 | 4/2005 |
| JP | A-2005-099083 | 4/2005 |
| JP | A-2005-099085 | 4/2005 |
| JP | A-2006-276073 | 10/2006 |
| WO | WO 2005/103833 A1 | 11/2005 |

OTHER PUBLICATIONS

Nov. 16, 2010 Japanese Office Action issued in Japanese Patent Application No. 2006-326889 (with translation).

* cited by examiner

*Primary Examiner* — Thorl Chea
(74) *Attorney, Agent, or Firm* — Oliff PLC

(57) ABSTRACT

The invention provides a toner for electrostatic image development having a binder resin containing a amorphous polyester resin and a crystalline polyester resin, and a coloring agent, and satisfying the following relationship (1):

$$SP(L)>SP(H)>SP(C) \quad (1)$$

wherein SP(H) is the solubility parameter of a resin contained in an elution fraction F (0-10) from the beginning of elution of W1 until 10% of elution of W1 when W1 is the whole area of an elution curve on a gel permeation chromatograph measured for an acetone-soluble fraction; SP(L) is the solubility parameter of a resin contained in an elution fraction F (80-100) from 80% to 100% of the elution of W1; and SP(C) is the solubility parameter of the crystalline polyester resin.

13 Claims, 2 Drawing Sheets

TONER FOR ELECTROSTATIC IMAGE DEVELOPMENT, METHOD OF PRODUCING THE SAME, ELECTROSTATIC IMAGE DEVELOPER, TONER CARTRIDGE, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2006-326889 filed Dec. 4, 2006.

BACKGROUND

1. Technical Field

The invention relates to a toner for electrostatic image development, a method of producing the same, an electrostatic image developer, a toner cartridge, a process cartridge, and an image forming apparatus.

2. Related Art

Generally, according to electrophotographic methods, a latent image is formed electrically by various units on the surface of a photoreceptor (latent image holding member) which utilizes a photoconductive substance, and the formed latent image is developed with a toner to form a toner image, and thereafter this toner image is transferred onto the surface of an image receiving material such as paper or the like, if necessary via an intermediate transfer material. The transferred image is subjected to a fixing process such as heating, pressurizing, heat-pressurizing, or the like, such that a fixed image is formed. Toner which remains on the surface of the photoreceptor is generally cleaned with a blade in a cleaning step.

As a fixing technique for fixing a toner image which has been transferred onto a surface of an image receiving material, a thermal roll fixing method wherein an image receiving material having a toner image transferred thereon is inserted between a pair of rolls composed of a heating roll and a pressure roll to fix the image is commonly used. In addition, as a similar technique, a technique in which one or both of the rolls is substituted with a belt is also known. In these techniques, an image that is fixed fast can be obtained at high speed and with high energy efficiency, because of direct contact with the image, as compared with other fixing methods.

With increased demand for reduction of the power required for image formation in recent years, techniques for developing a toner at low temperatures aimed at saving electric power consumed in the fixing process, which consumes a certain amount of the energy used in image formation, and at broadening the conditions for fixing, are increasingly necessary.

In a toner containing a crystalline polyester resin, however, the crystalline polyester resin is poor in resin strength, and upon exposure to the surface of the toner, is liable to filming (adhesion as a film) on the surface of a development roll or a photoreceptor, often leading to image quality defects in a short time, particularly in a high-speed machine using a high process speed.

SUMMARY OF THE INVENTION

According to an aspect of the invention, there is provided a toner for electrostatic image development having a binder resin containing a amorphous polyester resin and a crystalline polyester resin, and a coloring agent, and satisfying the following relationship (1):

$$SP(L)>SP(H)>SP(C) \quad (1)$$

wherein SP(H) is the solubility parameter of a resin contained in an elution fraction (F) (0-10) from the beginning of elution of W1 until 10% of the elution of W1 wherein W1 is the whole area of an elution curve on a gel permeation chromatograph measured for an acetone-soluble fraction; SP(L) is the solubility parameter of a resin contained in an elution fraction (F) (80-100) from 80% to 100% of the elution of W1; and SP(C) is the solubility parameter of the crystalline polyester resin.

BRIEF DESCRIPTION OF DRAWINGS

Exemplary embodiment of the present invention will be described in detail based on the following figures, wherein.

DETAILED DESCRIPTION OF THE INVENTION

<Toner for Electrostatic Image Development>

Figure 1:
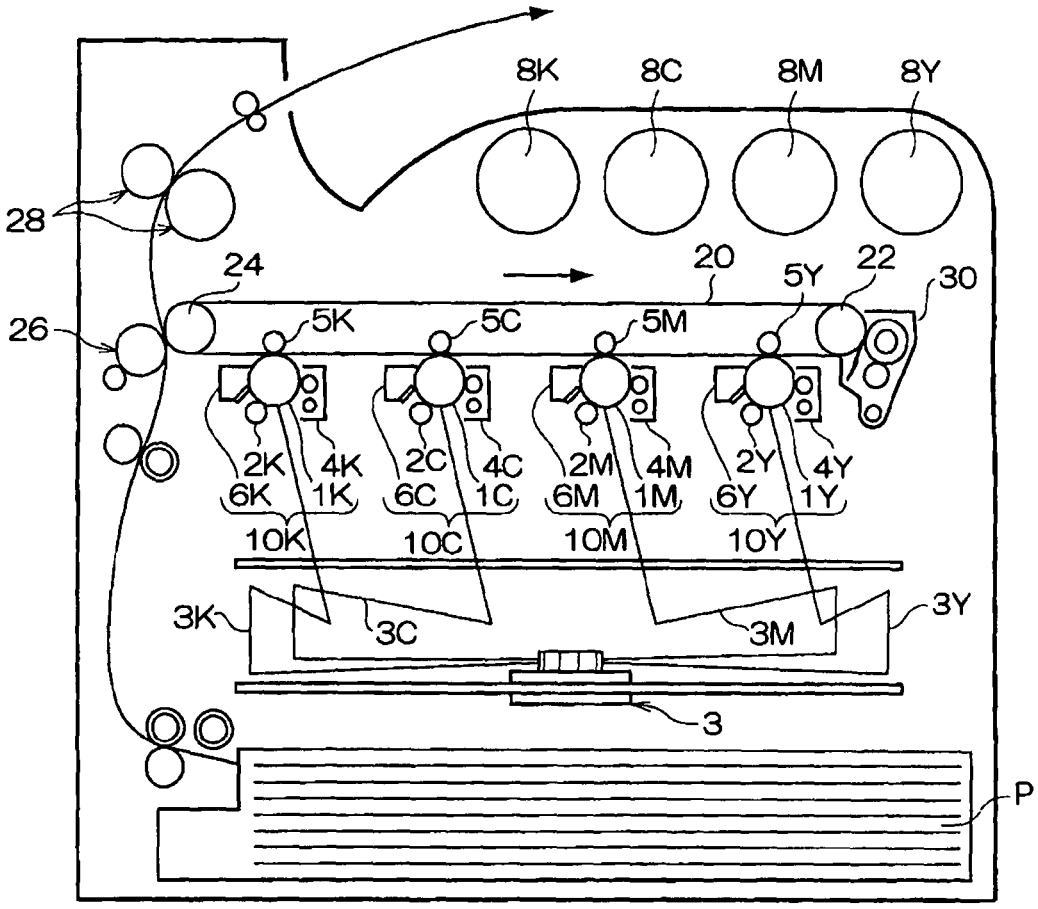
FIG. 1 is a schematic block diagram showing one example of the image forming apparatus of the invention.

The toner for electrostatic image development according to an aspect of the invention (hereinafter referred sometimes to merely as "toner") having a binder resin containing a amorphous polyester resin and a crystalline polyester resin (hereinafter referred sometimes to merely as "amorphous resin" and "crystalline resin", respectively), and a coloring agent, and satisfying the following relationship (1):

$$SP(L)>SP(H)>SP(C) \quad (1)$$

wherein SP(H) is the solubility parameter of a resin contained in an elution fraction (F) (0-10) from the beginning of elution of W1 until 10% of the elution of W1 wherein W1 is the whole area of an elution curve on a gel permeation chromatograph measured for an acetone-soluble fraction; SP(L) is the solubility parameter of a resin contained in an elution fraction (F) (80-100) from 80% to 100% of the elution of W1; and SP(C) is the solubility parameter of the crystalline polyester resin.

Use of the crystalline polyester resin as a binder resin is effective for low-temperature fixation of the toner, but in this case, the portion of a layer-forming member or a development roll which is rubbed and abraded with the toner in the inside of the developing apparatus is liable to filming because the crystalline resin poor in mechanical strength is present on a surface layer of the toner. Accordingly, the functions of members are lowered thus causing the problems of cleaning insufficiency, reduction in the density of an image, etc. This problem arises significantly in a high-speed machine at a particularly high rubbing speed, to generate influence on an image in a short time.

The low-temperature fixation refers to fixation of the toner under heating at about not more than 120° C. In the invention, the term "crystalline polyester resin" refers to a resin indicating not stepwise change in an endothermic amount but a clear endothermic peak in differential scanning calorimetry (DSC). In contrast, the term "amorphous resin (amorphous polymer)" refers to a resin indicating stepwise change in an endothermic amount in DSC.

To address the problem described above, it is desired to reduce the amount of the crystalline polyester resin in the surface layer of the toner without significantly reducing the content of the crystalline polyester resin in the toner.

As a result of examination, the inventors found that the amorphous polyester resin and crystalline polyester resin contained as the binder resin in the toner are made different from each other in compatibility in the surface layer of the toner and in the inside thereof, whereby the exposure of the crystalline polyester resin to the surface of the toner can be reduced thus preventing filming on the surfaces of a development roll and a photoreceptor.

Specifically, the emulsification aggregation method comprises aggregating, with divalent or more metal ions, resin particles in a resin particle dispersion and then fusing and coalescing the resin particles aggregated by heating etc., to prepare toner particles, and when a high-molecular-weight component and low-molecular-weight component in the amorphous resin used are made different in compatibility with the crystalline resin, the crystalline resin is made compatible selectively with the high-molecular-weight component and fixed in the high-molecular-weight amorphous resin in the fusing/coalescing step, and the low-molecular-weight amorphous resin having lower affinity for the crystalline resin than that of the high-molecular-weight component is present around the high-molecular-weight amorphous resin in a compatibilized state, whereby the crystalline resin can be prevented from being exposed to the surface of the toner.

Although the reason for formation of the above structure is not evident, it is considered that because the molecular weight of the low-molecular-weight amorphous resin is lower than that of the high-molecular-weight component, the low-molecular-weight component can fuse and coalesce at lower temperatures, and as a result, the high-molecular-weight amorphous resin highly compatible with, and incorporating, the crystalline resin is included in the molten low-molecular-weight amorphous resin hardly containing the crystalline resin, and the high-molecular-weight amorphous resin appears as if it is an island existing in the sea of the low-molecular-weight amorphous resin. Because the low-molecular-weight amorphous resin poor in affinity for the crystalline resin is present therearound, the crystalline resin would be made effectively compatibilized and fixed in the high-molecular-weight amorphous resin, thereby suppressing the exposure of the crystalline resin to the surface of the toner.

The "high-molecular-weight" and "low-molecular-weight" will be described in detail.

The structure of the toner is virtually very complicated and hardly specified, but the inventors found that the toner having the above characteristics can be specified by examining the relationship between the solubility parameter (SP value) of each component in the toner and the SP value of the crystalline polyester resin, separated by gel permeation chromatography (GPC) used in measurement of the molecular weight of resin.

The SP value is a value defined by the Fedors method.

Specifically, the acetone-soluble part of the toner is measured by GPC under the conditions described later, and when an eluate separated through a column is fractionated and the whole area of its elution curve is W1, the solubility parameter SP(H) of the resin contained in an elution fraction (F) (0-10) from the beginning of elution of W1 until 10% of the elution of W1, and the solubility parameter SP(L) of the resin contained in an elution fraction (F) (80-100) from 80% to 100% of the elution of W1 are determined and compared with the solubility parameter SP(C) of the crystalline polyester resin.

In this case, the resin contained in the elution fraction F (0-10) is a high-molecular-weight component in the binder resin, and the resin contained in the elution fraction F (80-100) is a low-molecular-weight component in the binder resin, and how these resin components are compatible with the crystalline polyester resin can be judged by determining the SP values of these components.

Because the acetone-soluble part in the toner is measured in the invention, most of the resin in the elution fractions F (0-10) and (80-100) is the amorphous resin.

In the invention, the SP(H), SP(L) and SP(C) should satisfy the following relationship (1):

$$SP(L)>SP(H)>SP(C) \quad (1)$$

Generally, a lower SP value is indicative of higher hydrophobicity, and a smaller difference in SP value between substances is indicative of higher affinity between the substances. It follows that by keeping the SP value in the above relationship, the affinity of the crystalline resin for the high-molecular-weight component in the amorphous resin is improved, and when the aggregated amorphous resin and crystalline resin are fused and coalesced, the crystalline resin can be effectively compatibilized with and incorporated into the high-molecular-weight component of the amorphous resin. On the other hand, the low-molecular-weight component has a SP value closer to that of the high-molecular-weight component than that of the crystalline resin, and is thus not compatible with the crystalline resin as compared with the high-molecular-weight component, and in this state, surrounds and encloses the high-molecular-weight component having the crystalline resin incorporated therein, as described above.

The molecular weight of the resin contained in the elution fractions F (0-10) and F (80-100) is not generalized because the molecular weight of the binder resin varies depending on the toner, and the weight-average molecular weight of the resin contained in the elution fraction F (0-10) is desirably in the range of 25000 to 100000, more preferably in the range of 30000 to 70000. The molecular weight of the resin contained in the elution fraction F (80-100) is desirably in the range of 8000 to 20000, more preferably in the range of 10000 to 20000.

Now, the SP value (solubility parameter) is described.

The SP value is solubility parameter and is a numerical expression indicative of how two substances are solubilized in each other. This SP value is represented by attracting force between two molecules, that is, represented by cohesive energy density (CED) square root. CED is an energy quantity required for evaporation of 1 ml substance.

Specifically, the SP value in the invention can be calculated according to the Fedors method by using the equation (3):

$$SP \text{ value (solubility parameter)} = (\text{CED value})^{1/2} = (E/V)^{1/2} \quad (3)$$

In the equation (3), E is molecular cohesion energy (cal/mol) and V is molecular volume ($cm^3$/mol), and E and V are represented by the following equations (4) and (5) respectively:

$$E=\Sigma\Delta ei \quad (4)$$

$$V=\Sigma\Delta vi \quad (5)$$

wherein Δei is the evaporation energy of an atomic group, and Δvi is molar volume.

For a compound having a glass transition point (Tg) of 25° C. or more, the following value is added to molar volume Δvi. That is, When n<3, Δvi+4 n When n≥3, Δvi+2 n n is the number of atoms in a major-chain skeleton in the minimum repeating unit of a polymer.

There are various theories on the method of calculating the SP value, and the generally used Fedors method is used in the invention. For this calculation method and data on evaporation energy Δei and molar volume Δvi of each atomic group, "Secchaku-no-kisoriron (Basic Theory of Adhesion)", chapter 5 (written by Minoru Imoto and published by Kobunshi Kankokai) is used as a reference. For groups such as —$CF_3$ group not shown therein, R. F. Fedors, Polym. Eng. Sci. 14, 147 (1974) is referred to.

For reference, the SP value represented by the equation (3) can be expressed in $(J/cm^3)^{1/2}$ by multiplying the SP value by 2.046 or in the SI unit $(J/m^3)^{1/2}$ by multiplying it by 2046.

For example, when a high-molecular-weight resin and a low-molecular-weight resin are synthesized respectively and mixed with each other, the SP value of the mixed resin can be easily calculated. On the other hand, when an additional monomer is added during polymerization to change the resin skeleton, calculation of the SP value from the compounding ratio is difficult. Calculation of the SP value of a resin contained in a toner itself is difficult because its composition is generally unclear.

On the other hand, calculation of the SP value by the Fedors method is made feasible by specifying the type and proportion of monomers constituting the resin. Accordingly, a mixture of a high-molecular-weight resin and a low-molecular-weight resin is separated from each other by GPC, and the SP value of each separated component can be calculated by the analytical method described above, whereby the SP value can be calculated.

That is, in GPC measurement with THF (tetrahydrofuran) as a mobile phase, an eluate is fractionated with a fraction collector etc., and fractions corresponding to a desired molecular weight, out of the whole area W1 of its elution curve, are combined. The combined eluate is concentrated and dried in an evaporator or the like, and the resulting solids are dissolved in a heavy solvent such as heavy chloroform or heavy THF and then measured by $^1$H-NMR, and from the integral ratio of each element, the constituent ratio of the eluted components in the resin can be calculated.

In an alternative method, the eluate is concentrated and hydrolyzed with sodium hydroxide or the like, and the decomposed product can be qualitatively and quantitatively analyzed by high performance liquid chromatography (HPLC) to calculate the ratio of constituent monomers.

Calculation of SP value by the Fedors method is made feasible by specifying the type and ratio of monomers constituting the resin, and when the monomer species are specified by the above analysis, the SP value is determined by adding up the composition ratios of monomers in the order of a decreasing ratio until the total sum of their ratios reaches 90 mol % (that is, residual monomers are not added in calculation of the SP value).

As described above, the resin component in the toner is extracted as an acetone-soluble part in the invention, and thus even if the resin contained in the toner is a mixture of crystalline polyester resin and amorphous polyester resin, almost of the resin contained in the elution fractions F (0-10) and (80-100) is a amorphous polyester resin. Accordingly, the determined SP value of the resin in the eluate is the SP value of a high-molecular-weight component and low-molecular-weight component in the amorphous resin in the binder resin of the toner.

The crystalline polyester resin contained in the binder resin may be analyzed by observing a section of the toner and examining its crystalline polyester resin portion by X-ray micro analyzer (XMA) or may be analyzed by examining, out of the components by GPC, combined fractions based on the crystalline polyester resin according to the method described above. Alternatively, the crystalline polyester resin is isolated by separation from the amorphous polyester resin by utilizing the low solubility of the crystalline polyester resin in a polar solvent and then measured by $^1$H-NMR or its decomposed product after hydrolysis is identified by HPLC, whereby the ratio of constituent monomers can be calculated and the SP value can be determined.

Hereinafter, the constitution of the toner for electrostatic image development according to the aspect of the invention is described in detail.

The toner of the aspect of the invention should contain a binder resin containing a amorphous polyester resin and a crystalline polyester resin, and a coloring agent.

(Crystalline Polyester Resin)

The toner of the aspect of the invention can realize low-temperature fixation by incorporation of a crystalline polyester resin.

As described above, the crystalline polyester resin in the aspect of the invention refers to a resin showing not stepwise change in an endothermic amount but a clear endothermic peak in differential scanning calorimetry (DSC), and may be any resin having the endothermic peak, and a copolymer having a crystalline polyester main chain with which another component was copolymerized, wherein another component is 50 mol % or less, can be referred to as the crystalline polyester resin. That is, the copolymer showing the endothermic peak is referred to as the crystalline polyester resin. Hereinafter, preferable examples of the crystalline polyester are shown below, but are not limited thereto.

In the crystalline polyester resin, an acid serving as an acid-derived constituent component includes various dicarboxylic acids, among which aliphatic dicarboxylic acids and aromatic dicarboxylic acids are preferable, and the aliphatic dicarboxylic acids are particularly preferably linear carboxylic acids. The dicarboxylic acid as the acid-derived constituent component is not limited to one kind of dicarboxylic acid, and may contain two or more kinds of dicarboxylic acid-derived components. The dicarboxylic acid may contain a sulfonic acid group in some cases in order to improve emulsifiability in an emulsification aggregation method.

The "acid-derived constituent component" refers to a constituent site which is an acid component before synthesis of polyester resin, and the "alcohol-derived constituent component" refers to a constituent site which is an alcohol component before synthesis of polyester resin.

Examples of the aliphatic dicarboxylic acid include, but are not limited to, oxalic acid, malonic acid, succinic acid, glutaric acid, adipic acid, pimelic acid, suberic acid, azelic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid or lower alkyl esters and acid anhydrides thereof. In consideration of easy availability, adipic acid, sebacic acid, 1,10-decanedicarboxylic acid and 1,12-dodecanedicarboxylic acid are preferable.

An aromatic dicarboxylic acid may be added to the aliphatic dicarboxylic acid, and the aromatic dicarboxylic acid includes, for example, terephthalic acid, isophthalic acid, o-phthalic acid, t-butylisophthalic acid, 2,6-naphthalenedicarboxylic acid, 4,4'-biphenyldicarboxylic acid etc., among which terephthalic acid, isophthalic acid and t-butylisophthalic acid are preferable from the viewpoint of easy availability and easy emulsifiability. The amount of these aromatic dicarboxylic acids added is preferably 20 mol % or less, more preferably 10 mol % or less, still more preferably 5 mol % or less. When the amount of the aromatic dicarboxylic acid added is higher than 20 mol %, emulsification may be difficult, or crystallinity may be inhibited, and image glossiness unique to the crystalline polyester resin cannot be obtained or the depression of melting point may be caused to deteriorate the storage stability of the image in some cases.

In the crystalline polyester resin, an alcohol serving as an alcohol-derived constituent component is desirably an aliphatic diol, and the aliphatic diol includes, but is not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octanedecanediol and 1,20-eicosanediol. Among these, ethylene glycol, 1,4-butanediol, 1,6-hexanediol, 1,9-nonanediol and 1,10-decanediol are preferable in consideration of easy availability.

In the alcohol-derived constituent component, the content of the aliphatic diol-derived constituent component is 80 mol % or more, more preferably 90 mol % or more and, if necessary, other component may be contained. When the content of the aliphatic diol-derived constituent component is less than 80 mol %, the crystallinity of the polyester resin is deteriorated and the melting point is lowered, and thus toner blocking resistance, image storability, and low-temperature fixability may be deteriorated in some cases.

The other component which is contained as necessary includes constituent components such as a diol-derived constituent component having a double bond and a diol-derived constituent component having a sulfonic acid group. Examples of the diol having a double bond include 2-butene-1,4-diol, 3-butene-1,6-diol, and 4-butene-1,8-diol. The content of the diol-derived constituent components having a double bond in all the acid-derived constituent components is preferably 20 mol % or less, more preferably 2 to 10 mol %. When the content of the diol-derived constituent component having a double bond exceeds 20 mol %, the crystallinity of the polyester resin is deteriorated, the melting point is lowered, and the image storability is deteriorated in some cases.

The crystalline polyester resin in the invention is desirably an aliphatic crystalline polyester resin. The composition ratio of the aliphatic polymerizable monomer constituting the aliphatic crystalline polyester resin is preferably 60 mol % or more, more preferably 90 mol % or more. As the aliphatic polymerizable monomer, the above-mentioned aliphatic diols and dicarboxylic acids can be preferably used.

In this case, the crystalline polyester resin is preferably an aliphatic crystalline polyester resin obtained by reacting a C10 to C12 dicarboxylic acid with a C4 to C9 diol, in order to make the SP value of the crystalline polyester resin lower than the SP value of the amorphous polyester resin.

The number of carbon atoms of dicarboxylic acid is preferably 4 to 12 and the number of carbon atoms of diol is preferably 4 to 9.

The crystalline polyester resin can be produced at a polymerization temperature of 180 to 230° C. and, if necessary, a reaction system is evacuated, and the reaction is performed while water and an alcohol produced during the condensation are removed.

When the polymerizable monomer is not dissolved or is not compatible at the reaction temperature, a high boiling point solvent may be added as a solubilizer to dissolve the monomer. A polycondensation reaction is performed while the solubilizer is distilled off. When a polymerizable monomer poor in compatibility is present in copolymerization reaction, the polymerizable monomer poor in compatibility and an acid or alcohol to be polycondensed with the polymerizable monomer are previously condensed and, thereafter, the condensate may be polycondensed with a main component.

Examples of catalysts usable in production of the polyester resin include compounds of alkali metals such as sodium and lithium, compounds of alkali earth metals such as magnesium and calcium, compounds of metals such as zinc, manganese, antimony, titanium, tin, zirconium and germanium, phosphorous acid compounds, phosphoric acid compounds and amine compounds.

The weight-average molecular weight (Mw) of the crystalline polyester resin is preferably 6,000 to 35,000, more preferably in the range of 6,000 to 30,000. When the molecular weight (Mw) is less than 6,000, the strength of fixed image for resistance to bending may be deteriorated, while when the weight-average molecular weight (Mw) is greater than 35,000, the crystalline polyester resin may be hardly incorporated into the high-molecular-weight amorphous resin.

The weight average molecular weight can be measured by gel permeation chromatography (GPC). Measurement of the molecular weight by GPC was carried out with THF solvent in a measuring instrument GPC-HLC-8120 manufactured by Tosoh Corporation and a column TSK gel Super HM-M (15 cm) manufactured by Tosoh Corporation. From this measurement result, the weight-average molecular weight is calculated by using a molecular weight calibration curve prepared using monodisperse polystyrene standard samples.

The melting point of the crystalline polyester resin used in the invention is preferably in the range of 60 to 120° C., more preferably in the range of 70 to 100° C. When the crystalline polyester resin has a melting point of lower than 60° C., the powder may be easily aggregated or the storability of fixed image may be deteriorated. On the other hand, when the melting point thereof exceeds 120° C., image roughening may be caused and low-temperature fixation may be suppressed.

The melting point of the crystalline polyester resin is determined as the peak temperature of an endothermic peak obtained by the differential scanning calorimetry (DSC).

The content of the crystalline polyester resin in the toner is desirably in the range of 1 to 40 wt %, more desirably in the range of 5 to 30 wt %. When the content of the crystalline polyester resin is less than 1 wt %, sufficient low-temperature fixability may not be obtained, while when the content is greater than 40 wt %, crushed toners are generated due to the softness of the crystalline resin, and there may easily occur filming of a photoreceptor and image quality defects due to pollution of members in an image forming system using charging rolls and transfer rolls.

(Amorphous Polyester Resin)

The amorphous polyester resin used in the aspect of the invention can be known polyester resin. The amorphous polyester resin is synthesized from a polyvalent carboxylic acid component and a polyvalent alcohol component. As the amorphous polyester resin, a commercially available product may be used or a synthesized product may be used. The amorphous polyester resin may be a single kind of amorphous polyester resin or a mixture of two or more polyester resins.

The polyvalent alcohol component in the amorphous polyester resin includes, for example, divalent alcohol components such as ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexane dimethanol, dipropylene glycol, polyethylene glycol, polypropylene glycol, bisphenol A, and hydrogenated bisphenol A. Moreover, as trivalent or higher alcohol component, glycerol, sorbitol, 1,4-sorbitan, trimethylol propane, or the like can be used.

Examples of the divalent carboxylic acid component condensed with the polyvalent alcohol component include aromatic carboxylic acids such as terephthalic acid, isophthalic acid, phthalic acid anhydride, trimellitic acid anhydride, pyromellitic acid and naphthalenedicarboxylic acid, aliphatic carboxylic acids such as maleic acid anhydride, fumaric acid, succinic acid, alkenylsuccinic acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid, and alicyclic carboxylic acids such as cyclohexanedicarboxylic acid, as well as lower acid alkyl esters and acid anhydrides of these acids, and one or more of these compounds can be used.

Particularly when alkenylsuccinic acid or anhydrides thereof are used out of these polyvalent carboxylic acids, the amorphous polyester resin can be made more easily compatible with the crystalline polyester resin because of the presence of an alkenyl group having higher hydrophobicity than other functional groups. Examples of the alkenylsuccinic acid component can include n-dodecylsuccinic acid, n-dodecenylsuccinic acid, isododecylsuccinic acid, isododecylsuccinic acid, isododecenylsuccinic acid, n-octylsuccinic acid and n-octenylsuccinic acid, as well as anhydrides, acid chlorides and C1 to C3 lower alkyl esters thereof.

By incorporation of trivalent or more carboxylic acids, the high-molecular chain can form a crosslinked structure, and by the crosslinked structure, there can be brought about an effect that the crystalline polyester resin once made compatible with the amorphous resin is fixed and hardly separated.

Typical examples of the trivalent or higher carboxylic acids include trimellitic acid such as 1,2,4-benzenetricarboxylic acid and 1,2,5-benzenetricarboxylic acid, and 1,2,4-naphthalenetricarboxylic acid, hemimellitic acid, trimesic acid, mellophanic acid, prehnitic acid, pyromellitic acid, mellitic acid and 1,2,3,4-butanetetracarboxylic acid, as well as acid anhydrides, acid chlorides and C1 to C3 lower alkyl esters thereof, among which trimellitic acid is particularly preferable. These may be used alone or as a mixture of two or more thereof.

It is preferable that, as an acid component, in addition to the aforementioned aliphatic dicarboxylic acids and aromatic dicarboxylic acids, dicarboxylic acid component having a sulfonic acid group is contained. The dicarboxylic acid having a sulfonic acid group is effective in that a coloring material such as a pigment can be dispersed better. In the case where dicarboxylic acid has a sulfonic acid group, when resin fine particles are prepared by emulsifying or suspending an entire resin in water, it is also possible to emulsify or suspend the resin without using a surfactant as described later.

From the reason described above, a component containing at least one of alkenylsuccinic acid and anhydrides thereof and at least one of trimellitic acid and anhydrides thereof reacted therein is desirably contained in the amorphous polyester resin, and its component is desirably contained in the high-molecular-weight component of the amorphous resin playing an important role in rendering it compatible with the crystalline polyester resin and in fixing the crystalline polyester resin.

Accordingly, the above component is desirably contained in the elution fraction F (0-10) in the invention.

The content, in the elution fraction F (0-10) (solid content), of the component containing the specific acid reacted therein is desirably in the range of 1 to 30 wt %. Whether the component containing at least one of alkenylsuccinic acid and anhydrides thereof and at least one of trimellitic acid and anhydrides thereof reacted therein is contained or not can be confirmed by analysis for calculation of the ratio of constituent monomers in the elution component by GPC.

A component containing at least one of alkenylsuccinic acid and anhydrides thereof and at least one of trimellitic acid and anhydrides thereof reacted therein may be contained in the elution fraction F (80-100) reflecting the low-molecular-weight part, but the low-molecular-weight component is desirably not so compatible with the crystalline polyester resin as described above, and thus it is preferable to satisfy the following relationship:

$$0 \leq B < A \quad (2)$$

wherein A and B are the contents (weight percentage), in the elution fractions F (0-10) and F (80-100) respectively, of a component containing at least one of alkenylsuccinic acid and anhydrides thereof reacted therein.

The amount (wt % in the elution fraction) of the component containing at least one of alkenylsuccinic acid and anhydrides thereof reacted therein, contained in the elution fractions F (0-10) and F (80-100), can be determined by $^{1}$H-NMR and HPLC in the same manner as for the method of calculating the SP value.

The molecular weight of the amorphous polyester resin is not particularly limited, and for example, when the high-molecular-weight component and low-molecular-weight component resins are synthesized respectively and used as binder resin, the weight-average molecular weight Mw of the high-molecular-weight component resin is desirably in the range of 30000 to 200000, more preferably in the range of 30000 to 100000, still more preferably in the range of 35000 to 80000.

By regulating the molecular weight of the high-molecular-weight component in this range, the amorphous resin can be rendered more easily compatible with the crystalline resin, and the crystalline resin once rendered compatible with the amorphous resin can be prevented from being separated.

The Mw of the low-molecular-weight component resin is desirably in the range of 8000 to 25000, more preferably in the range of 8000 to 22000, still more preferably in the range of 9000 to 20000.

By regulating the molecular weight of the low-molecular-weight component in this range, the incorporation of the high-molecular-weight component including the crystalline resin upon coalescence therewith is made excellent, and the crystalline resin can be prevented from being exposed to the surface of the toner.

Production of the amorphous polyester resin can be carried out in accordance with production of the crystalline polyester resin described above.

When the high-molecular-weight component resin and the low-molecular-weight resin are mixed with each other and used as binder resin, the compounding ratio of the two, that is, P/Q (P: weight of high-molecular-weight component, Q: weight of low-molecular-weight component) is desirably in the range of 10/90 to 70/30, more desirably in the range of 20/80 to 70/30, still more desirably in the range of 25/75 to 70/30. By regulating the compounding ratio in this range, almost all of the high-molecular-weight component and low-molecular-weight component used in mixing are contained in the high-molecular-weight elution fraction F (0-10) and low-molecular weight elution fraction F (80-100) respectively, to make regulation easy.

(Coloring Agent)

The coloring agent used in the toner of the aspect of the invention may be a dye or pigment, and a pigment is preferable from light resistance and water resistance.

Preferable examples of the coloring agent that can be used include known pigments such as carbon black, aniline black, aniline blue, calcoyl blue, chrome yellow, ultramarine blue, DuPont oil red, quinoline yellow, methylene blue chloride, phthalocyanine blue, malachite green oxalate, lamp black, rose bengal, quinacridone, benzidine yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, C.I. Pigment Blue 15:3, etc.

The content of the coloring agent in the toner for electrostatic image development according to the aspect of the invention is desirably in the range of 1 to 30 parts by weight based on 100 parts by weight of the binder resin. It is also effective to use the coloring agent whose surface is treated as necessary, or a pigment dispersant. By selecting the type of the coloring agent, a yellow toner, magenta toner, cyan toner, black toner etc. can be obtained.

(Other Additives)

The toner of the aspect of the invention may contain a release agent as necessary. The release agent includes, for example, paraffin wax such as low-molecular-weight polypropylene, low-molecular-weight polyethylene etc.; silicone resin; rosin; rice wax; carnauba wax; etc. The melting point of the release agent is desirably 50 to 100° C., more desirably 60° C. to 95° C. The content of the release agent in the toner is desirably 0.5 to 15 wt %, more desirably 1.0 to 12 wt %. When the content of the release agent is less than 0.5 wt %, peeling deficiency may be caused particularly in oil-less fixation. When the content of the release agent is greater than 15 wt %, deterioration in toner fluidity may be caused to lower image qualities and reliability in image formation.

The toner of the aspect of the invention may further include various components such as internal additives, charge controlling agents, inorganic particulate matter (inorganic particles), and organic particles as necessary in addition to the components described above.

The internal additives can include magnetic substances, for example metals and alloys such as ferrite, magnetite, reduced iron, cobalt, nickel, and manganese, and compounds comprising such metals.

The inorganic particles are added for various purposes and may be added for regulation of the viscoelasticity of the toner. By regulating this viscoelasticity, image glossiness and penetration of the toner into paper can be regulated. As the inorganic particles, it is possible to employ known inorganic particles alone or as a mixture of two or more thereof, such as silica particles, titanium oxide particles, alumina particles, and cerium oxide particles, the surface of which may be hydrophobated, among which silica particles having a lower refractive index than that of the binder resin are preferably used from the viewpoint of preventing deterioration in coloring properties and transparency such as OHP transmission. The silica particles may be subjected to various kinds of surface treatments. For example, silica particles whose surface is treated with a silane-based coupling agent, a titanium-based coupling agent, silicone oil etc. are preferably used.

(Toner Characteristics)

The volume-average particle diameter of the toner in the aspect of the invention is desirably in the range of 4 to 9 μm, more desirably in the range of 4.5 to 8.5 μm, still more desirably in the range of 5 to 8 μm. When the volume-average particle diameter is less than 4 μm, the toner fluidity is lowered, the charging properties of each particle are easily deteriorated, and charging distribution is broadened, and thus blushing on the background or dropping of the toner from a developing device occurs easily. When the volume-average particle diameter of the toner is less than 4 μm, cleaning may be made particularly difficult in some cases. When the volume-average particle diameter of the toner is greater than 9 μm, the resolving power may be lowered thus failing to attain sufficient image qualities, so high image qualities required in recent years may be hardly satisfied in some cases.

The volume-average particle diameter can be measured by a Coulter Multisizer II (manufactured by Beckmann-Coulter) with an aperture diameter of 50 μm. In this case, the toner is dispersed in an electrolyte aqueous solution (ISOTON aqueous solution) and dispersed for 30 seconds or more by ultrasonic waves prior to measurement.

The toner of the aspect of the invention is preferably spherical with a shape factor SF1 in the range of 110 to 140. When the toner is spherical with a shape factor in this range, the transfer efficiency and image density can be improved to form a high-quality image.

The shape factor SF1 is more preferably in the range of 115 to 138.

The shape factor SF1 is determined according to the following equation (6):

$$SF1=(ML^2/A)\times(\pi/4)\times 100 \quad (6)$$

wherein ML represents the maximum length of toner particle, and A represents the projected area of toner particle.

The SF1 is numerically expressed by analyzing a microphotograph or a scanning electron microphotograph mainly with an image analyzer, and then calculated for example in the following manner. That is, an optical microscope image of the toner particles scattered on a slide glass is taken into a Luzex image analyzing apparatus through a video camera, and the maximum length and projected area of 100 particles are determined and calculated according to the formula (6) to determine the average value as SF1.

The method of producing the toner for electrostatic image development according to the invention includes a dry process and wet process. In this case, a method of rendering the high-molecular-weight component and low-molecular-weight component of the amorphous polyester resin different in SP value includes, but is not limited to, a method wherein the high-molecular-weight component resin and the low-molecular-weight component resin, which are polymerized respectively, are melt-mixed with each other; a method which involves polymerization until the molecular weight of the resulting polymer is increased to a certain degree and then adding a monomer component different in composition, followed by further polymerization to extend a resin skeleton different in composition; and a method which involves polymerizing the high-molecular-weight component and low-molecular-weight component respectively, then preparing their respective dispersions, and mixing them in an aggregating step.

However, the kneading milling method that is a dry process is not desirable because the structure cannot be controlled by separating the low-molecular-weight component from the high-molecular-weight component in the amorphous resin. The wet process includes an emulsification aggregation method, melt suspension method, dissolution suspension method, etc., and among these methods, the emulsification aggregation method is desirable from the viewpoint of controlling the distribution of the crystalline resin, controlling the structures of the high-molecular-weight component and low-molecular-weight component, and preventing variation in composition.

<Method of Producing the Toner for Electrostatic Image Development>

The method of producing the toner for electrostatic image development according to the aspect of the invention comprises an emulsification step of emulsifying crystalline polyester resin particles and amorphous polyester resin particles (hereinafter referred to sometimes as "crystalline resin particles" and "amorphous resin particles" respectively) by dispersing a crystalline polyester resin and a amorphous polyester resin respectively in an aqueous medium, an aggregation step of aggregating the crystalline polyester resin particles and amorphous polyester resin particles to form aggregated particles, and a fusing step of fusing the aggregated particles, whereby the toner for electrostatic image development according to the aspect of the invention is produced.

Through the respective steps described above, it is possible to efficiently produce toner particles wherein the high-molecular-weight amorphous resin having the crystalline resin incorporated therein is included in the molten low-molecular-weight amorphous resin not containing the crystalline resin so much.

Hereinafter, the method of producing the toner for electrostatic image development according to the invention is described by reference to the method of producing the same by the emulsification aggregation method.

The emulsification aggregation method comprises an emulsification step of emulsifying a starting material constituting a toner to form resin particles (emulsified particles), an aggregation step of forming aggregates of the resin particles, and a fusion step of fusing the aggregates. When the emulsification aggregation method is used, plural kinds of particles can be used to easily regulate the composition and structure changing from the inside to surface of the toner particle.

(Emulsification Step)

For example, formation of crystalline resin particles can be carried out with a dispersing machine by applying shear strength to a solution of the crystalline resin in an aqueous medium. In this case, the viscosity of the resin components can be reduced by heating to form the particles. A dispersant can also be used for stabilizing the dispersed resin particles. When the resin is to be dissolved in an oily solvent relatively poor in solubility in water, the resin can be dissolved in the solvent and its particles can be dispersed together with a dispersant or a polymer electrolyte in water and then heated or depressurized to evaporate the solvent, thereby preparing a dispersion of the crystalline resin particles.

In the case of the amorphous resin, a dispersion of the amorphous resin particles can be prepared in the manner described above.

The aqueous medium includes, for example, water such as distilled water, deionized water etc. and alcohols, and the aqueous medium is preferably water only.

The dispersant used in the emulsification step includes, for example, water-soluble polymers such as polyvinyl alcohol, methyl cellulose, ethyl cellulose, hydroxyethyl cellulose, carboxymethyl cellulose, sodium polyacrylate, sodium polymethacrylate, etc., surfactants, for example, anionic surfactants such as sodium dodecylbenzenesulfonate, sodium octadecylsulfate, sodium oleate, sodium laurate, potassium stearate etc.; cationic surfactants such as laurylamine acetate, stearylamine acetate, lauryltrimethyl ammonium chloride etc., amphoteric surfactants such as lauryldimethylamine oxide, nonionic surfactants such as polyoxyethylene alkyl ether, polyoxyethylene alkyl phenyl ether, polyoxyethylene alkyl amine, etc., and inorganic salts such as tricalcium phosphate, aluminum hydroxide, calcium sulfate, calcium carbonate, barium carbonate, etc.

The content of the resin particles in the emulsified liquid in the emulsification step is desirably in the range of 10 to 50 wt %, and more desirably in the range of 20 to 40 wt %. When the content is less than 10 wt %, the particle size distribution is broadened and toner characteristics are deteriorated in some cases. When the content is greater than 50 wt %, uniform stirring is made difficult, and toners having uniform characteristics with a narrow particle size distribution are difficult to obtain in some cases.

In the method of dispersing the emulsified liquid, the dispersing machine used in dispersing the emulsified liquid includes, for example, a homogenizer, a homomixer, a pressure kneader, an extruder, a media-dispersing machine etc.

The size of the resin particles, in terms of average particle diameter (volume-average particle size), is desirably in the range of 0.01 to 1.0 μm, more preferably in the range of 0.03 to 0.6 μm, still more desirably in the range of 0.03 to 0.4 μm.

In the method of dispersing the coloring agent, a generally employed device such as rotation shearing homogenizer, media-containing ball mill, sand mill or dynomill may be used and is not particularly limited.

If necessary, a surfactant may be used to prepare an aqueous dispersion of the coloring agent, or a dispersant can be used to prepare a dispersion of the coloring agent in an organic solvent. Hereinafter, the dispersion of the coloring agent is referred to sometimes as "colorant dispersion". The surfactant and dispersant used in dispersion can be in accordance with the dispersant that can be used in dispersing the crystalline polyester resin etc.

The amount of the coloring agent added is preferably in the range of 1 to 20 wt %, more preferably in the range of 1 to 10 wt %, still more preferably in the range of 2 to 10 wt %, further more preferably in the range of 2 to 7 wt %, based on the total amount of the polymer.

When a coloring agent is mixed in the emulsification step, the coloring agent can be mixed with the polymer by mixing the coloring agent or a dispersion of the coloring agent in an organic solvent with a solution of the polymer in an organic solvent.

(Aggregation Step)

In the aggregation step, a dispersion of the crystalline resin particles, a dispersion of the amorphous resin particles and a colorant dispersion are mixed with one another to prepare a mixture which is then aggregated by heating to a temperature not higher than the glass transition temperature of the amorphous resin, to prepare aggregated particles. Formation of the aggregated particles is carried out by regulating the mixture in the acid pH range under stirring. The pH is desirably in the range of 2 to 7, more desirably in the range of 2.2 to 6, still more preferably in the range of 2.4 to 5. In this case, use of an aggregating agent is effective.

As the aggregating agent, a surfactant having polarity reverse to that of a surfactant used as the dispersant, an inorganic metal salt or a divalent or more metal complex can be preferably used. In particular, when a metal complex is used, the amount of the surfactant used can be decreased, and charging property is improved, being particularly preferable.

The inorganic metal salt includes, for example, metal salts such as calcium chloride, calcium nitrate, barium chloride, magnesium chloride, zinc chloride, aluminum chloride and aluminum sulfate, and inorganic metal salt polymers such as poly(aluminum chloride), poly(aluminum hydroxide) and poly(calcium sulfide). Among these compounds, the aluminum salts and polymers thereof are particularly preferable. For attaining a sharper particle-size distribution, the valence of the inorganic metal salt is more preferably divalent than monovalent, trivalent than divalent, or tetravalent than trivalent.

In preparing the toner particles in the invention, it is desired that only a dispersion of resin particles is introduced into an aggregation system, and the resin particles only are aggregated, and then dispersions of a coloring agent and a release agent are introduced. By so doing, the resin particles can, due to the presence of release agent particles etc., be prevented from being aggregated, whereby the desired toner particle structure described above can be efficiently obtained.

When the particle diameter of the aggregated particles reaches a desired particle diameter, additional amorphous resin particles are added thereby preparing a toner having core aggregated particles coated with the amorphous resin. In this case, the crystalline resin is hardly exposed to the surface of the toner, which is a preferable constitution from the viewpoint of charging property and developability. Before additional amorphous resin particles are added, an aggregating agent may be added or the pH may be adjusted.

(Fusing Step)

In the fusing step, the pH of the aggregated particle dispersion is increased in the range of 3 to 9 under stirring conditions in accordance with those of the aggregation step, whereby the progress of aggregation is terminated, and the aggregated particles are fused by heating to a temperature not less than the melting point of the crystalline resin. When the aggregated particles are coated with the amorphous resin, the amorphous resin is also fused whereby the core aggregated particles are coated therewith. Heating may be carried out for such a period of time as to effect fusion, and may be conducted for about 0.5 to 10 hours.

After fusion, the aggregated particles are cooled to give fused particles. In the step of cooling, crystallization may be promoted by slow cooling, that is, by slowing the cooling rate within the range of the melting point of the crystalline resin ±15C°.

The fused particles obtained by fusion can be subjected to a solid-liquid separation step such as filtration and, if necessary, to a washing step and drying step to form toner particles.

In the aspect of the invention, external additives such as fluidizers and auxiliaries may be added to treat the toner particles. The usable external additives include known particles, for example inorganic particles such as surface-hydrophobized silica particles, titanium oxide particles, alumina particles, cerium oxide particles and carbon black, and polymer particles such as polycarbonate, polymethyl methacrylate, and silicone resin, and at least two kinds of the external additives are used, and these preferably have an average primary particle diameter in the range of 30 nm to 200 nm, and more preferably in the range of 30 nm to 180 nm.

When the average primary particle diameter of the external additive is less than 30 nm, the toner is initially excellent in flowability, but cannot reduce the non-electrostatic adhesion between the toner and a photoreceptor, thus reducing the efficiency of transfer, easily generating filming, and causing significantly varying density on images in some cases. Due to stress with time in a developing device, the particles are embedded in the surface of the toner to change charging property and to cause problems such as reduction in copy density and blushing in background in some cases. When the average primary particle diameter is greater than 200 nm, the external additive may be easily removed from the surface of the toner, and flowability may be deteriorated to cause filming.

<Developer for Electrostatic Image>

The toner for electrostatic image development according to the aspect of the invention may be used as a one-component developer as it is, or may be used in a two-component developer. When the toner is to be used in a two-component developer, it is mixed with a carrier to form a two-component developer.

The carrier usable in the two-component developer is not particularly limited, and any known carrier can be used. Examples thereof include magnetic metals such as iron oxide, nickel, and cobalt; magnetic oxides such as ferrite and magnetite; resin coated carriers each having a resin coating layer on the surface of the core material; and magnetic dispersion type carriers. The carrier may also be a resin dispersion carrier in which an electrically conductive material or the like is dispersed in a matrix resin.

Examples of the coating resin or matrix resin usable in the carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin comprising organosiloxane bonds or a modified product thereof; a fluororesin, a polyester, a polycarbonate, a phenolic resin, and an epoxy resin.

Examples of the electrically conductive material include, but are not limited to, metals such as gold, silver, and copper; carbon black; and titanium oxide, zinc oxide, barium sulfate, aluminum borate, potassium titanate, tin oxide, and carbon black.

Examples of the core material of the carrier include magnetic metals, such as iron, nickel, and cobalt; magnetic oxides such as ferrite and magnetite; and a glass bead. The core material is preferably a magnetic substance when the carrier is used in the magnetic brush method. The volume-average particle diameter of the core material of the carrier is generally in the range of 10 to 500 μm, desirably in the range of 30 to 100 μm.

In order to coat the surface of the core material of the carrier with resin, a coating liquid for forming the resin layer containing the resin and other optional additives dissolved in an appropriate solvent can be applied to form a coating layer. The solvent is not particularly limited, and may be selected as appropriate in consideration of the coating resin used, suitability for coating, and the like.

Specific examples of the resin coating method include the immersion method in which the core material of the carrier is immersed in the coating liquid; the spray method in which the coating liquid is sprayed onto the surface of the core material of the carrier; the fluidized bed method in which the coating liquid is sprayed onto the core material of the carrier that is floated by fluidizing air; and the kneader coater method in which the core material of the carrier is mixed with the coating liquid in the kneader coater and the solvent is removed.

The mixing ratio (ratio by weight) of the toner of the invention to the above-mentioned carrier in the two-component developer is preferably in the range of about 1:100 (toner to carrier) to 30:100, more preferably in the range of about 3:100 to 20:100.

<Image Forming Apparatus>

Next, the image forming apparatus using the toner for electrostatic image development according to the aspect of the invention will be explained.

The image forming apparatus of the aspect of the invention comprises a photoreceptor, a developing unit for developing an electrostatic image as a toner image formed on the photoreceptor with a developer, a transfer unit for transferring the toner image formed on the photoreceptor onto a transfer apparatus, and a fixing unit for fixing the toner image transferred onto the transfer apparatus, wherein the electrostatic image developer of the invention is used as the developer.

In the image forming apparatus, for example, the part containing the developing unit may be a cartridge structure (process cartridge) attachable to, and detachable from, the main apparatus of the image forming apparatus, and the process cartridge includes at least a developer retainer, and the process cartridge of the invention for holding the electrostatic image developer of the invention can be preferably used.

Hereinafter, the image forming apparatus of the invention is described in detail by reference to one example, but is not limited thereto. Principal parts shown in the figure are described, and description of other parts is omitted.

FIG. 1 is a schematic block diagram showing a full-color image-forming apparatus in a 4-tandem system. The image forming apparatus shown in FIG. 1 is provided with first to fourth image forming units 10Y, 10M, 10C, and 10K in an electrophotographic system outputting an image of each color of yellow (Y), magenta (M), cyan (C) and black (K) based on color-separated image data. These image forming units (hereinafter referred to simply as "units") 10Y, 10M, 10C, and 10K are horizontally arranged with a predetermined space therebetween. The units 10Y, 10M, 10C and 10K may be process cartridges attachable to, and detachable from, the main apparatus of the image forming apparatus.

Over the respective units 10Y, 10M, 10C and 10K, an intermediate transfer belt 20 is arranged as an intermediate transfer apparatus through the respective units. The intermediate transfer belt 20 is arranged by being wound around a driving roller 22 and support roller 24 in contact with the inner surface of the intermediate transfer belt 20, the rollers 22 and 24 being arranged to be apart from each other from the left to right, and runs in the direction of from the first unit 10Y to the fourth unit 10K. The support roller 24 is biased with a spring or the like (not shown) so as to be apart from the driving roller 22, and a predetermined tension is applied to the intermediate transfer belt 20 wound between the two rollers. The image-holding side of the intermediate transfer belt 20 is provided with a intermediate transfer apparatus cleaning unit 30 opposite to the driving roller 22.

Developing units 4Y, 4M, 4C and 4K for the respective units 10Y, 10M, 10C and 10K can be supplied with 4-color (yellow, magenta, cyan, black) toners held in toner cartridges 8Y, 8M, 8C and 8K.

The first to fourth units 10Y, 10M, 10C and 10K have a constitution similar to one another so that only the first unit 10Y forming a yellow image, arranged upstream of the intermediate transfer belt, is described. A description of the second to fourth units 10M, 10C and 10K is omitted by assigning reference marks given magenta (M), cyan (C) and black (K) in place of yellow (Y) given to the equivalent part of the first unit 10Y.

The first unit 10Y has a photoreceptor 1Y acting as a photoreceptor 1Y. The photoreceptor 1Y is provided therearound with a charging roller 2Y for charging the surface of the photoreceptor 1Y at a predetermined voltage, an exposure unit 3 for exposing the charged surface to a laser light 3Y based on color-separated image signals to form an electrostatic image, a development apparatus 4Y for developing the electrostatic image by feeding a negatively charged toner to the electrostatic image, a primary transfer roller 5Y (primary transfer unit) for transferring the developed toner image onto the intermediate transfer belt 20, and a photoreceptor cleaning unit 6Y for removing a toner remaining on the surface of the photoreceptor 1Y after primary transfer (each of 2M, 2C and 2K is also a charging roller).

The primary transfer roller 5Y is arranged in the inside of the intermediate transfer belt 20 and arranged in a position opposite to the photoreceptor 1Y (each of 1M, 1C and 1K is also a photoreceptor). A bias power source (not shown) for applying primary transfer bias is connected to each of primary transfer rollers 5Y, 5M, 5C and 5K. Each bias power source can change the transfer bias applied to each primary transfer roller by a control part (not shown).

Hereinafter, the operation of forming a yellow image in the first unit 10Y is described. First, the surface of the photoreceptor 1Y is charged at a voltage of about −600 V to −800V with a charging roller 2Y prior to operation.

The photoreceptor 1Y is formed by laminating a photosensitive layer on an electroconductive (volume resistivity at 20° C.: $1\times10^{-6}$ Ωcm or less) substrate. This photosensitive layer is usually highly resistant (with approximately the same resistance as that of general resin), but upon irradiation with laser ray 3Y, changes the property of changing the specific resistance of the portion irradiated with the laser ray. According to image data for yellow sent from a control part (not shown), the layer ray 3Y is outputted via the exposure device 3 onto the surface of the charged photoreceptor 1Y. The photosensitive layer on the surface of the photoreceptor 1Y is irradiated with the laser ray 3Y, whereby an electrostatic image in a yellow print pattern is formed on the surface of the photoreceptor 1Y (3M, 3C and 3K are also laser rays).

An electrostatic image is an image formed on the surface of the photoreceptor 1Y by charging; that is, this image is a negative latent which is formed because the electrification charge of the surface of the photoreceptor 1Y flows due to a reduction in the specific resistance of the irradiated portion of the photosensitive layer, while charge remains on the portion not irradiated with laser ray 3Y.

The electrostatic image thus formed on the photoreceptor 1Y is rotated to a predetermined development position with running of the photoreceptor 1Y. In this development position, the electrostatic image on the photoreceptor 1Y is formed into a visualized image (developed image) with the development device 4Y.

For example, 7 μm yellow toner having a volume-average particle diameter of 7 μm, containing at least a yellow coloring agent, a crystalline resin and a amorphous resin, is accommodated in the development device 4Y. The yellow toner is stirred in the inside of the development device 4Y and thereby frictionally electrified and retained on a developer roll (developer retainer) by having the same polarity (negative polarity) as that of electrification charge on the photoreceptor 1Y. Then, the surface of the photoreceptor 1Y passes through the development device 4Y thereby allowing the yellow toner to adhere electrostatically to the electrically neutralized latent image portion on the surface of the photoreceptor 1Y, thus developing the latent image with the yellow toner. The photoreceptor 1Y having the yellow toner image formed thereon is subsequently delivered at a predetermined speed, and the toner image developed on the photoreceptor 1 is sent to a predetermined primary transfer position.

When the yellow toner image on the photoreceptor 1Y is sent to the primary transfer position, a predetermined primary transfer bias is applied to the primary transfer roller 5Y, and electrostatic force sent from the photoreceptor 1Y to the primary transfer roller 5Y is allowed to act on the toner image, and the toner image on the photoreceptor 1Y is transferred onto the intermediate transfer belt 20. The transfer bias to be applied has (+) polarity reverse to the polarity (−) of the toner, and for example, the first unit 10Y is regulated at about +10 μA by a control part (not shown).

On the other hand, the toner remaining on the photoreceptor 1Y is removed and recovered by a cleaning unit 6Y (each of 6M, 6C and 6K is also a photoreceptor cleaning unit).

The primary transfer bias applied to primary transfer rollers 5M, 5C and 5K after second unit 10M is also controlled in the same manner as in the first unit.

The intermediate transfer belt 20 having the yellow toner image transferred thereon in the first unit 10Y is delivered through the second to fourth units 10M, 10C, and 10K in this order, whereby multiple toner images of colors are transferred.

The intermediate transfer belt 20 having multiple toner images of 4 colors transferred thereon through the first to fourth units reaches a secondary transfer part composed of the intermediate transfer belt 20, the support roller 24 in contact with the inner surface of the intermediate transfer belt 20, and a secondary transfer roller (a secondary transfer unit) 26 arranged in the side of the image-retaining surface of the intermediate transfer belt 20. On one hand, a recording paper (image receiving material) P is fed via a feeding mechanism with predetermined timing into a gap between the secondary transfer roller 26 and the intermediate transfer belt 20 which are contacted with each other with pressure, and a predetermined secondary transfer bias is applied to the support roller 24. The transfer bias to be applied has the same (−) polarity as the polarity (−) of the toner, and electrostatic force sent from the intermediate transfer belt 20 to the recording paper P is allowed to act on the toner image, and the toner image on the intermediate transfer belt 20 is transferred onto the recording paper P. The secondary transfer bias is determined depending on resistance detected by a resistance detector (not shown) for detecting the resistance of the secondary transfer part and is voltage-controlled.

Thereafter, the recording paper P is sent to a fixing unit 28 where the toner image is heated, and the toner image of layered colors is fused and fixed on the recording paper P. After fixation of the color image is finished, the recording paper P is delivered to a discharging part and a series of these color image-forming operations are finished.

The image forming apparatus illustrated above is constituted such that a toner image is transferred via the intermediate transfer belt 20 onto the recording paper P, but this constitution is not intended to be limitative and the image forming apparatus may be structured such that a toner image may be transferred from the photoreceptor directly onto the recording paper.

<Process Cartridge, Toner Cartridge>

Figure 2:
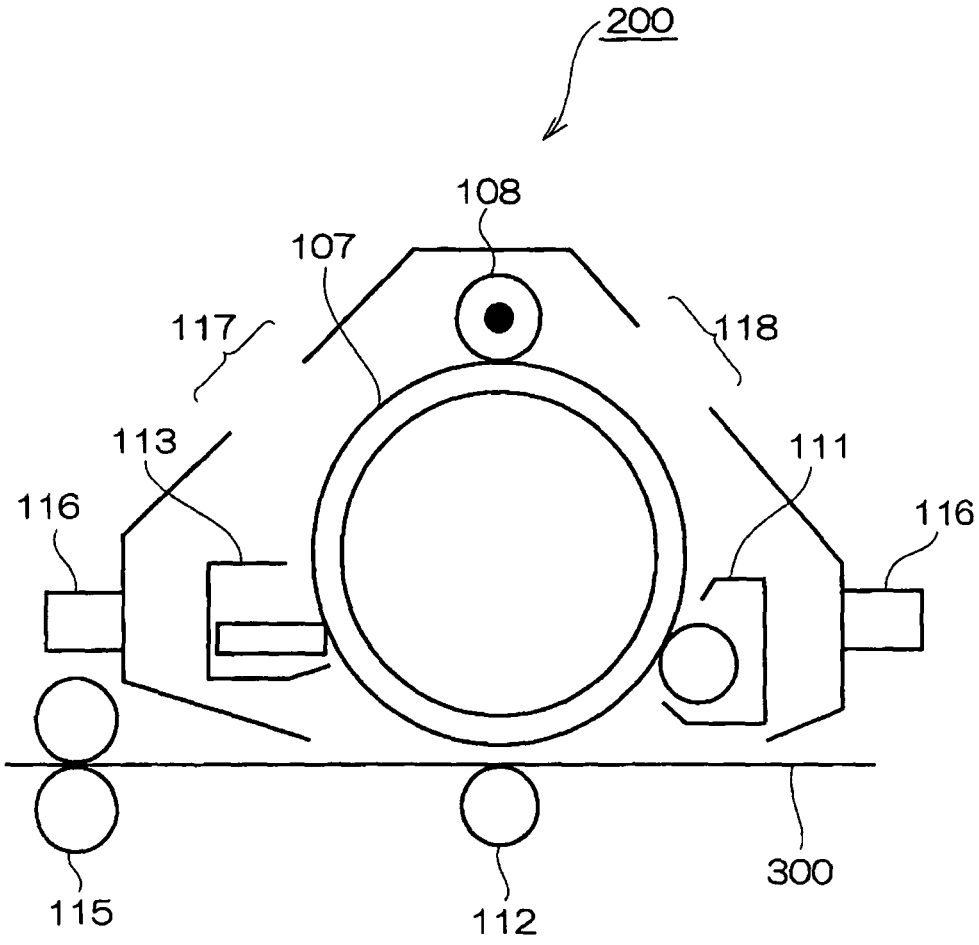
FIG. 2 is a schematic block diagram showing one example of the process cartridge of the invention.

FIG. 2 is a schematic block diagram showing one preferable example of the process cartridge for holding the electrostatic image developer of the invention. The process cartridge 200 includes a charging roller 108, a development device 111, a photoreceptor cleaning unit 113, an opening 118 for light exposure, and an opening 117 for electricity removal and light exposure, which are combined with an attachment rail and integrated with a photoreceptor 107.

Then, the process cartridge 200 is arbitrarily attachable to and detachable from the main apparatus of the image forming apparatus constituted from the transfer device 112, the fixing device 115 and other component parts (not shown), and together with the main apparatus of the image forming apparatus, constitutes the image forming apparatus. Reference numeral 300 denotes a recording paper.

The process cartridge shown in FIG. 2 is provided with the charging device 108, the development device 111, the cleaning device 113, the opening 118 for light exposure, and the opening 117 for electricity removal and light exposure, and these devices can be arbitrarily combined.

The process cartridge of the invention is provided with the photoreceptor 107 and at least one member selected from the group consisting of the charging device 108, the development device 111, the cleaning device 113, the opening 118 for light exposure, and the opening 117 for electricity removal and light exposure.

Then, the toner cartridge of the invention is described. The toner cartridge of the invention is a toner cartridge fit detachably to the image forming apparatus and accommodating at least a toner to be fed to a development unit arranged in the image forming apparatus, wherein the toner is the toner of the invention. The toner cartridge of the invention may accommodate at least a toner, and for example a developer may also be accommodated therein depending on the mechanism of the image forming apparatus.

In the image forming apparatus constituted to be capable of attaching or detaching the toner cartridge, the toner cartridge accommodating the toner of the invention can be utilized to maintain storage stability particularly in a small container and to attain low-temperature fixation while maintaining high image qualities.

The image forming apparatus shown in FIG. 1 is an image forming apparatus constituted to be capable of attaching and detaching the toner cartridges 8Y, 8M, 8C and 8K, and the development units 4Y, 4M, 4C and 4K are connected via toner feeding pipes (not shown) to the toner cartridges corresponding to the respective development units (colors). When the toner accommodated in the toner cartridge is reduced, the toner cartridge can be exchanged with another.

EXAMPLES

Hereinafter, the invention will be described in detail with reference to Examples, but it should be understood that the invention is not restricted thereby. The "parts" and "%" in the Examples below mean respectively "parts by weight" and "% by weight", unless otherwise specified.

<Method of Measuring Various Characteristics>

First, methods of measuring physical properties of the toner etc. used in the Examples and Comparative Examples (excluding the previously described methods) are described.

(Methods of Measuring Molecular Weight and Molecular-Weight Distribution of Resin)

In the invention, the molecular weight and molecular-weight distribution of the crystalline polyester resin etc. are determined under the following conditions: In GPC, an HLC-8120GPC, SC-8020 unit (manufactured by Tosoh Corporation) is used, and the columns used are two TSK gel, Super HM-H columns (manufactured by Tosoh Corporation, 6.0 mm ID×15 cm), and the eluent used is THF (tetrahydrofuran). The experimental conditions are: sample concentration: 0.5%, flow rate: 0.6 ml/min, sample injection: 10 μl, measurement temperature: 40° C.; and detector: IR detector. The calibration curve is prepared by using 10 polystyrene TSK standard samples manufactured by Tosoh Corporation: A-500, F-1, F-10, F-80, F-380, A-2500, F-4, F-40, F-128, and F-700.

The data collection interval in sample analysis is 300 ms.

(Volume-Average Particle Diameters of Resin Particles, Colorant Particles, etc.)

The volume-average particle diameters of the resin particles, colorant particles, etc., are measured by using a laser diffraction-type particle size distribution measurement device (LA-700, manufactured by Horiba Ltd.).

(Melting Point and Glass Transition Temperature of Resin)

The melting point of the crystalline resin and the glass transition point (Tg) of the amorphous resin are determined by measurement according to ASTM D3418-8, by using a differential scanning calorimeter (trade name: DSC60, with automatic tangent line processing system, manufactured by Shimadzu Corporation) from 25° C. to 150° C. under the condition of a heating rate of 10° C./min. The melting point is the peak temperature of an endothermic peak, and the glass transition point is the temperature at a midpoint in a stepwise change in endothermic amount.

<Preparation of each Dispersion>

(Amorphous Polyester Resin Dispersion)

The respective materials are introduced at the composition ratio shown in Table 1 into a reaction container equipped with a stirrer, a thermometer, a condenser and a nitrogen gas introduction tube, the atmosphere in the reaction container is replaced by a dry nitrogen gas, and the catalyst shown in Table 1 is added. The reaction mixture is reacted at 195° C. for 6 hours in a nitrogen gas stream, then heated to a temperature of 240° C. and reacted for 6.0 hours with stirring, and the reaction container is depressurized to a pressure of 10.0 mmHg and reacted for 0.5 hours under reduced pressure to give pale yellow and transparent amorphous polyester resins (1) to (7).

TABLE 1

| | | Resin (1) | Resin (2) | Resin (3) | Resin (4) | Resin (5) | Resin (6) | Resin (7) |
|---|---|---|---|---|---|---|---|---|
| Acid Component (mol %) | Dimethyl Terephthalate | 40 | 70 | 20 | 65 | 25 | 20 | 90 |
| | Dimethyl Fumarate | 20 | 10 | 55 | 15 | 50 | 75 | 10 |
| | Dedecenyl Succinic Acid Anhydride | 35 | 25 | 25 | 20 | 20 | — | — |
| | Trimellitic Acid Anhydride | 5 | — | — | — | 5 | 5 | — |
| Alcohol Component (mol %) | BPA-EO | 10 | 10 | 15 | 30 | 10 | 10 | 70 |
| | BPA-PO | 90 | 90 | 85 | 70 | 90 | 90 | 30 |
| Catalyst (mol %) | Dibutyltin Oxide | 0.05 | 0.05 | 0.05 | 0.05 | 0.05 | 0.05 | 0.05 |

BPA-EO: Bisphenol A-Ethylene Oxide (1 mol) Adduct

BPA-PO: Bisphenol A-Propylene Oxide (1 mol) Adduct

Then, the resulting amorphous polyester resins (1) to (7) are dispersed with a high temperature/high pressure dispersing machine rebuilt from a CABITRON CD1010 (manufactured by Eurotech). Each amorphous polyester resin dispersion is regulated to have a composition of 80% deionized water and 20% polyester resin having a pH value adjusted to 8.5 with ammonia, and stirred with a revolving stirrer at 60 Hz at a pressure of 5 kg/cm$^2$ under heating at 140° C. by a heat exchanger in the CABITRON to give amorphous polyester resin dispersions (1) to (7) (solid content: 20%).

The molecular weights and SP values of the resulting amorphous polyester resins (1) to (7) and the volume-average particle diameters of particles in the resin dispersions are shown in Table 2.

TABLE 2

| | | Resin (1) | Resin (2) | Resin (3) | Resin (4) | Resin (5) | Resin (6) | Resin (7) |
|---|---|---|---|---|---|---|---|---|
| Resin | Weight-Average Molecular Weight | 45000 | 14000 | 38000 | 12000 | 42000 | 65000 | 1000 |
| | SP value (cal$^{1/2}$ · cm$^{3/2}$) | 9.90 | 10.02 | 9.86 | 10.06 | 9.96 | 10.10 | 10.39 |
| Resin Dispersion | Volume-Average Particle Diameter (μm) | 0.160 | 0.142 | 0.134 | 0.183 | 0.172 | 0.170 | 0.175 |

(Crystalline Polyester Resin Dispersion)

As shown in Table 3, the respective materials are mixed in the shown proportion in a flask, then heated to 220° C. in an atmosphere under reduced pressure and subjected to dehydration condensation reaction for 6 hours, whereby crystalline polyester resins (a) to (c) are obtained.

TABLE 3

| | | Resin (a) | Resin (b) | Resin (c) |
|---|---|---|---|---|
| Acid Component (mol %) | Dimethyl Dodecanedioate | 52 | 53 | — |
| | Dimethyl Terephthalate | — | — | 52 |

TABLE 3-continued

| | | Resin (a) | Resin (b) | Resin (c) |
|---|---|---|---|---|
| Alcohol Component (mol %) | 1,6-Hexanediol | — | 47 | — |
| | 1,9-Nonanediol | 48 | — | 48 |
| Catalyst (mol %) | Dibutyltin Oxide | 0.05 | 0.05 | 0.05 |

Then, 80 parts of the crystalline polyester resins (a) to (c) and 720 parts of deionized water are introduced into a stainless steel beaker which is then dipped in a water bath and heated to 98° C. The crystalline polyester resin when rendered molten is stirred at 7000 rpm with a homogenizer (trade name: Ultra-Turrax T50, manufactured by IKA). Then, the sample is emulsified and dispersed while 1.8 parts of an anionic surfactant (trade name: Neogen RK, solid content 20%, manufactured by Dai-ichi Kogyo Seiyaku Co., Ltd.) are added dropwise thereto, whereby crystalline polyester resin dispersions (a) to (c) (solid content: 10%) are obtained.

The molecular weights and SP values of the resulting crystalline polyester resins (a) to (c) and the volume-average particle diameters of particles in the resin dispersions are shown in Table 4.

TABLE 4

| | | Resin (a) | Resin (b) | Resin (c) |
|---|---|---|---|---|
| Resin | Weight-Average Molecular Weight | 25000 | 22000 | 18000 |
| | Melting Point (° C.) | 69 | 68 | 89 |
| | SP value (cal$^{1/2}$ · cm$^{3/2}$) | 9.00 | 9.13 | 10.30 |
| Resin Dispersion | Volume-Average Particle Diameter (μm) | 0.165 | 0.179 | 0.138 |

(Colorant Dispersion)

Cyan pigment (trade name: Pigment Blue 15:3, copper phthalocyanine, manufactured by Dainichiseika Colour & Chemicals Mfg. Co., Ltd.): 1000 parts Anionic surfactant (trade name: Neogen RK, manufactured by Dai-ichi Kogyo Seiyaku Co., Ltd.): 150 parts Deionized water: 9000 parts The above components are mixed, dissolved and then dispersed for 1 hour with a high-pressure impact type dispersing machine Altimizer (trade name: HJP30006, manufactured by Sugino Machine Limited).

In the resulting colorant dispersion, the volume-average particle diameter D50 of the colorant particles is 0.15 μm, and the concentration of the colorant is 23%.

(Release Agent Dispersion)

Paraffin Wax HNP 9 (melting point 72° C., manufactured by Nippon Seiro Co., Ltd.): 45 parts Anionic surfactant (trade name: Neogen RK, manufactured by Dai-ichi Kogyo Seiyaku Co., Ltd.): 5 parts Deionized water: 200 parts The above components are heated to 95° C., dispersed with a homogenizer (trade name: Ultra Turrax T50, manufactured by IKA Co.), and subjected to dispersing treatment with a Manton Golin high pressure homogenizer (Golin Co.) to prepare a release agent dispersion in which a release agent having a volume average particle diameter of 210 nm is dispersed (release agent concentration: 20%).

Example 1

(Production of Toner)

Toner dispersion (1): 138 parts

Toner dispersion (2): 138 parts

Toner dispersion (a): 100 parts

The above dispersions are sufficiently mixed and dispersed by a homogenizer (trade name: Ultra-Turrax T50, manufactured by IKA) in a round-bottomed stainless flask. Then, 0.15 parts of polyaluminum chloride are added and dispersed using the Ultra-Turrax.

Colorant dispersion: 22 parts

Release agent dispersion: 50 parts

Then, the above dispersions are added, and 0.05 parts of polyaluminum chloride are added and dispersed using the Ultra-Turrax.

A stirrer and a mantle heater are arranged, and the slurry is heated to 50° C. at a rate of 0.5° C./min. while the number of revolutions of the stirrer is regulated so as to stir the slurry sufficiently, and then the slurry is kept at 50° C. for 15 minutes and then heated at 0.05° C./min., during which time the particle diameter is measured at 10-minute intervals using a Coulter Multisizer II (aperture diameter of 50 μm, manufactured by Beckmann-Coulter), and when the volume-average particle diameter becomes 5.0 μm, 50 parts of the resin dispersion (1) and 50 parts of the resin dispersion (2) (additional resins) are introduced over 3 minutes into the slurry. After introduction, the slurry is left for 30 minutes and then adjusted to pH 9.0 with 5% aqueous sodium hydroxide. Thereafter, the sample, which is adjusted to pH 9.0 every time the temperature is increased by 5° C., is heated to 96° C. at a rate of 1° C./min. and then kept at 96° C. The sample is measured every 30 minutes for particle shape and surface with an optical microscope and a scanning electron microscope (FE-SEM), and the particles become spherical in 5 hours and are then cooled to 20° C. at a rate of 1° C./min. thereby solidifying the particles.

Thereafter, the reaction product is filtered, washed sufficiently with deionized water and dried with a vacuum drying machine, whereby toner particles having a volume-average particle diameter of 5.9 μm are obtained.

In the Examples and Comparative Examples below, the particle diameters of the toner particles are similar to one another.

1 part of colloidal silica (trade name: R972, 16 nm, manufactured by Nippon Aerosil Co., Ltd.) and 1 part of hydrophobic silica (trade name: X24, 140 nm, manufactured by Shin-Etsu Chemical) are added to 100 parts of the obtained toner particles and these components are mixed and blended using a Henschel mixer to give toner A having silica externally added thereto. The number-average particle diameter of silica is measured by observing, with an FE-SEM, the state of silica adhering to the surface of the toner, measuring the maximum diameter of 200 external additive particles, and preparing a particle-diameter distribution to determine the particle diameter at the peak. In this case, the peak is observed at 16 nm and 140 nm.

(Production of Electrostatic Image Developer)

0.10 parts of carbon black (trade name: VXC-72, manufactured by Cabot Corporation) are added to 1.25 parts of toluene and then stirred and dispersed with a sand mill for 20 minutes to give a carbon dispersion which is then mixed by stirring with 1.25 parts of 80% trifunctional isocyanate in ethyl acetate (trade name: Takenate D110N, manufactured by Takeda Pharmaceutical Company Limited). The resulting coating agent resin solution, and Mn—Mg—Sr ferrite particles (volume-average particle diameter: 35 μm), are introduced into a kneader, mixed and stirred at 25° C. for 5 minutes, and heated to 150° C. at ordinary pressure to distill the solvent away. The sample is mixed and stirred for an additional 30 minutes, and after turning off the heater, the temperature of the sample is decreased to 50° C. The resulting coat carrier is sifted through a 75-μm mesh to prepare a carrier.

92 parts of the carrier and 8 parts of the toner A are mixed in a V-blender to give a developer A.

(Evaluation)

—Analysis of Toner Components—

100 mg of the toner A is introduced into 10 ml of acetone and stirred for 30 minutes at 25° C. to give a solution in which the soluble part is dissolved. This solution is filtered through a membrane filter having openings of 0.2 μm, and the acetone is distilled away from the filtrate, whereby an acetone-soluble part of the toner is obtained.

Then, this product is dissolved in THF and used as a sample for a GPC measurement, and injected into the GPC used for measurement of the molecular weight of each resin described above. In a GPC eluate discharge outlet, a fraction collector is arranged to fractionate an eluate every predetermined count, and an eluate corresponding to the first 10% area of an elution curve W1 (that is, an eluate eluted after the beginning of elution (rise of the curve) until the first 10% of the area of W1) and an eluate corresponding to the final 20% area of W1 are respectively collected, and THF is distilled away therefrom, whereby elution fractions F (0-10) and F (80-100) are obtained.

Then, 30 mg of each of the elution fractions F (0-10) and F (80-100) is dissolved in 1 ml of heavy chloroform, and tetramethylsilane (TMS) is added at a concentration of 0.05 vol % as standard. The solution is filled in a glass tube for NMR measurement and its spectrum is obtained by carrying out integration 128 times at a temperature of 23 to 25° C. with a nuclear magnetic resonance unit (trade name: JNM-AL400, manufactured by Nihon Denshi K. K.).

The monomer composition and the component ratio of the resin contained therein can be obtained from the peak integral ratio of the obtained spectrum. That is, peak assignment is carried out as follows, and from the integral ratio, the component ratio of the constituent monomer is determined. Peak can be assigned, for example, as follows: about 8.25 ppm, derived from a benzene ring of trimellitic acid (1 hydrogen); about 8.07 to 8.10 ppm, derived from a benzene ring of terephthalic acid (4 hydrogens); about 7.1 to 7.25 ppm, derived from a benzene ring of bisphenol A (4 hydrogens); about 6.8 ppm, derived from a benzene ring of bisphenol A (4 hydrogens) and a double bond of fumaric acid (2 hydrogens); about 5.2 to 5.4 ppm, derived from methine of bisphenol A propylene oxide adduct (1 hydrogen) and a double bond of alkenylsuccinic acid (2 hydrogens); about 3.7 to 4.7 ppm, derived from methylene of bisphenol A propylene oxide adduct (2 hydrogens) and methylene of bisphenol A ethylene oxide adduct (4 hydrogens); about 1.6 ppm, derived from a methyl group of bisphenol A (6 hydrogens); and about 0.8 to 0.9 ppm, derived from a terminal methyl group of alkenylsuccinic acid (12 hydrogens). From the results, the SP value of each resin is calculated from the equation (3). Confirmation of the presence or absence of a reaction component containing specific acid 1 (alkenylsuccinic acid and trimellitic acid) in F (0-10) and comparison of reaction components containing specific acid 2 (alkenylsuccinic acid) in F (0-10) and F (80-100) are carried out.

The results are collectively shown in Table 6.

—Characteristics of Actual Equipment—

The prepared developer A is set in a developing device in a modified model of Fuji Xerox's DocuCentre C7550 (in which the process speed is variable in the range of 100 mm/sec to 500 mm/sec, and the temperature of the fixing device is set at 160° C.), and 10000 sheets of paper are successively printed under environmental conditions of 32° C. and 90% RH at 2 process speeds of 104 mm/sec and 460 mm/sec, respectively.

The print image is a mixed chart of a solid image and letters, and all the copies have the same image printed thereon. After printing on 10000 sheets of paper, a halftone image on the whole surface of an A3 sheet (Cin (image density coverage indicative of image-area ratio per dot of input image data)=30%) is collected, and the effects on image quality and toner filming on the photoreceptor and the development roll are observed with the naked eye and evaluated under the following evaluation criteria. In the evaluation criteria, "a" and "b" are acceptable levels, while "c" and "d" are unacceptable levels.

a: There is no filming on the photoreceptor or the development roll. There is no problem with image quality.

b: Slight filming is observed on the photoreceptor or the development roll but there is no problem with image quality.

c: Filming is observed on the photoreceptor or the development roll and is also observed to influence image quality.

d: Filming is observed on the photoreceptor or the development roll and is also observed to influence image quality significantly.

The results are shown in Table 7.

Examples 2 to 5, Comparative Examples 1 to 4

Toners B to E and toners H to K are obtained by the same manner as in the preparation of toner particles and treatment with external additives in production of the toner in Example 1 except that the respective dispersions shown in Table 5 are used. These toners are used to carry out analysis of toner components and evaluation of characteristics in the actual machine in the same manner as in Example 1.

These results are collectively shown in Tables 6 and 7.

Example 6

Toner F is obtained in the same manner as in production of the toner in Example 1 except that RY50 (silica, 40 nm, manufactured by Aerosil Co.) is used as an external additive in place of X24. Two peaks (16 nm and 40 nm) are observed in the particle-size distribution of the external additives. These toners are used to carry out analysis of toner components and evaluation of characteristics in the actual machine in the same manner as in Example 1.

These results are collectively shown in Tables 6 and 7.

Example 7

Toner G is obtained in the same manner as in production of the toner in Example 1 except that 2 parts of R972 only are used as an external additive. One peak (16 nm) is observed in the particle-size distribution of the external additive. These toners are used to carry out analysis of toner components and evaluation of characteristics in the actual machine in the same manner as in Example 1.

These results are collectively shown in Tables 6 and 7.

TABLE 5

| | | Toners A, F, G | Toner B | Toner C | Toner D | Toner E | Toner H | Toner I | Toner J | Toner K |
|---|---|---|---|---|---|---|---|---|---|---|
| Formulation | Amorphous Polyester Resin Dispersion | Resin Dispersion (1) 138 parts Resin Dispersion (2) 138 parts | Resin Dispersion (3) 100 parts Resin Dispersion (4) 190 parts | Resin Dispersion (5) 200 parts Resin Dispersion (4) 50 parts | Resin Dispersion (6) 200 parts Resin Dispersion (7) 150 parts | Resin Dispersion (5) 200 parts Resin Dispersion (2) 50 parts | Resin Dispersion (6) 138 parts Resin Dispersion (2) 138 parts | Resin Dispersion (6) 125 parts Resin Dispersion (7) 150 parts | — Resin Dispersion (2) 250 parts | Resin Dispersion (3) 100 parts Resin Dispersion (2) 190 parts |
| | Crystalline Polyester Resin Dispersion | Resin Dispersion (a) 100 parts | Resin Dispersion (b) 150 parts | Resin Dispersion (b) 200 parts | Resin Dispersion (a) 150 parts | Resin Dispersion (b) 200 parts | Resin Dispersion (a) 100 parts | Resin Dispersion (c) 100 parts | Resin Dispersion (a) 100 parts | Resin Dispersion (c) 150 parts |
| | Release Agent Dispersion | 50 parts | 50 parts | 50 parts | 50 parts | 50 parts | 50 parts | 50 parts | 50 parts | 50 parts |
| | Colorant Dispersion | 22 parts | 22 parts | 22 parts | 22 parts | 22 parts | 22 parts | 22 parts | 22 parts | 22 parts |

TABLE 5-continued

| | | Toners A, F, G | Toner B | Toner C | Toner D | Toner E | Toner H | Toner I | Toner J | Toner K |
|---|---|---|---|---|---|---|---|---|---|---|
| Additional Resin | Amorphous Polyester Resin Dispersion | Resin Dispersion (1) 138 parts | — | — | — | — | Resin Dispersion (6) 50 parts | — | — | — |
| | | Resin Dispersion (2) 50 parts | Resin Dispersion (4) 60 parts | Resin Dispersion (4) 75 parts | — | Resin Dispersion (2) 75 parts | Resin Dispersion (2) 50 parts | Resin Dispersion (7) 100 parts | Resin Dispersion (2) 125 parts | Resin Dispersion (2) 60 parts |

TABLE 6

| | Toner | Peak Position of External Additive Particle Diameter | SP Value ($cal^{1/2} \cdot cm^{3/2}$) F (0–10) | SP Value ($cal^{1/2} \cdot cm^{3/2}$) F (80–100) | Amount of Specific Acid 2-Containing Component (wt %) F (0–10) | Amount of Specific Acid 2-Containing Component (wt %) F (80–100) |
|---|---|---|---|---|---|---|
| Example 1 | A | 16 nm and 140 nm | 9.92 | 10.00 | 18 | 12 |
| Example 2 | B | 16 nm and 140 nm | 9.89 | 10.03 | 12 | 10 |
| Example 3 | C | 16 nm and 140 nm | 9.99 | 10.02 | 10 | 10 |
| Example 4 | D | 16 nm and 140 nm | 10.14 | 10.35 | 0 | 0 |
| Example 5 | E | 16 nm and 140 nm | 9.99 | 10.00 | 10 | 12 |
| Example 6 | F | 16 nm and 140 nm | 9.92 | 10.00 | 18 | 12 |
| Example 7 | G | 16 nm | 9.92 | 10.00 | 18 | 12 |
| Comparative Example 1 | H | 16 nm and 140 nm | 10.30 | 10.08 | 0 | 12 |
| Comparative Example 2 | I | 16 nm and 140 nm | 10.15 | 10.32 | 0 | 0 |
| Comparative Example 3 | J | 16 nm and 140 nm | 10.05 | 10.02 | 12 | 12 |
| Comparative Example 4 | K | 16 nm and 140 nm | 9.89 | 10.00 | 12 | 12 |

TABLE 7

| | Toner (Developer) | SP Value Order | Presence or Absence of Specific Acid 1-Containing Component in F (0–10) | Comparison of Specific Acid 2-Containing Components in F (0–10) and F (80–100) | Photoreceptor Filming 104 mm/sec | Photoreceptor Filming 460 mm/sec | Development Roll Filming 104 mm/sec | Development Roll Filming 460 mm/sec |
|---|---|---|---|---|---|---|---|---|
| Example 1 | A | SP(L) > SP(H) > SP(C) | present | B < A | a | a | a | a |
| Example 2 | B | SP(L) > SP(H) > SP(C) | absent | B < A | a | a | a | b |
| Example 3 | C | SP(L) > SP(H) > SP(C) | present | B = A | a | b | a | b |
| Example 4 | D | SP(L) > SP(H) > SP(C) | absent | — | a | b | b | b |
| Example 5 | E | SP(L) > SP(H) > SP(C) | present | B > A | b | b | b | b |
| Example 6 | F | SP(L) > SP(H) > SP(C) | present | B < A | a | a | a | a |
| Example 7 | G | SP(L) > SP(H) > SP(C) | present | B < A | a | b | a | b |
| Comparative Example 1 | H | SP(H) > SP(L) > SP(C) | absent | B > A (=0) | c | d | c | d |
| Comparative Example 2 | I | SP(L) > SP(C) > SP(H) | absent | — | c | c | d | d |
| Comparative Example 3 | J | SP(L) > SP(C) | absent | B = A | c | d | d | d |
| Comparative Example 4 | K | SP(C) > SP(L) > SP(H) | absent | B = A | d | d | d | d |

The results shown in Tables 5 to 7 reveal that in the Examples wherein the toner showing that the SP value of the acetone-soluble part separated by GPC satisfies the relationship (1) is used, the crystalline polyester resin can be prevented to be exposed to the surface of the toner and filming resistance becomes excellent.

In the Comparative Examples, on the other hand, the SP value of the separated component does not satisfy the relationship (1), so it is considered that the toner cannot incorporate the crystalline polyester resin to deteriorate filming resistance.

Some embodiments of the present invention are described as follows.

The toner for electrostatic image development of the present invention, wherein the elution fraction F (0-10) comprises a component containing at least one of alkenylsuccinic acid and anhydrides thereof and at least one of trimellitic acid and anhydrides thereof reacted therein.

The toner for electrostatic image development of the present invention, which satisfies the following relationship (2):

$$0 \leq B < A \quad (2)$$

wherein A and B are the contents (weight percentage), in the elution fractions F (0-10) and F (80-100) respectively, of a component containing at least one of alkenylsuccinic acid and anhydrides thereof reacted therein.

The toner for electrostatic image development of the present invention, wherein the crystalline polyester resin is an aliphatic crystalline polyester resin obtained by reacting C10 to C12 dicarboxylic acid with C4 to C9 diol.

The toner for electrostatic image development of the present invention, wherein the content of the aliphatic diol-derived constituent component is about 80 mol % or more in the alcohol-derived constituent component of the crystalline polyester resin, The toner for electrostatic image development of the present invention, wherein the composition ratio of the aliphatic polymerizable monomer constituting the aliphatic crystalline polyester resin is about 60 mol % or more.

The toner for electrostatic image development of the present invention, wherein the crystalline polyester resin is a crystalline polyester resin having a weight-average molecular weight of about 6,000 to about 35,000.

The toner for electrostatic image development of the present invention, wherein the crystalline polyester resin is a crystalline polyester resin having a melting point of about 60° C. to about 120° C.

The toner for electrostatic image development of the present invention, wherein the content of the crystalline polyester resin in the toner is about 1 wt % to about 40 wt %.

The toner for electrostatic image development of the present invention, wherein the toner comprises a release agent having a melting point of about 50° C. to about 100° C.

The toner for electrostatic image development of the present invention, wherein the toner has a shape factor SF1 in the range of about 110 to about 140.

The toner for electrostatic image development of the present invention, wherein the toner comprises two or more kinds of external additives, and at least one of the external additives has a number-average primary particle diameter in the range of about 30 to about 200 nm.

The electrostatic image developer which comprises a toner, wherein the toner is the toner for electrostatic image development of the present invention.

The electrostatic image developer of the present invention which comprises a toner, wherein the toner is mixed with resin coated carriers.

The electrostatic image developer of the present invention which comprises a toner, wherein the toner is mixed with a resin dispersion carrier in which an electrically conductive material or the like is dispersed in a matrix resin.

The toner cartridge comprising at least a toner accommodated therein, wherein the toner is the toner for electrostatic image development of the present invention.

The process cartridge comprising at least a developer retainer having the electrostatic image developer of the present invention accommodated therein.

The image forming apparatus comprising a photoreceptor, a developing unit for developing an electrostatic image as a toner image formed on the photoreceptor with a developer, a transfer unit for transferring the toner image formed on the photoreceptor onto a transfer apparatus, and a fixing means for fixing the toner image transferred onto the transfer apparatus, wherein the developer is the electrostatic image developer of the present invention.

The method of producing a toner for electrostatic image development, which comprises emulsifying crystalline polyester resin particles and amorphous polyester resin particles by dispersing a crystalline polyester resin and a amorphous polyester resin respectively in an aqueous medium, aggregating the crystalline polyester resin particles and amorphous polyester resin particles to form aggregated particles, and fusing the aggregated particles, whereby the toner for electrostatic image development of the present invention 1 is produced.

According to the present invention, generation of filming on other members can be prevented in formation of images even under low-temperature fixation conditions, as compared with the case not having this constitution.

According to the invention, the compatibilization and fixation of the crystalline polyester resin in a high-molecular-weight component of the amorphous polyester resin can be promoted as compared with the case not having this constitution.

According to the invention, the compatibilization of the crystalline polyester resin in a low-molecular-weight component than in a high-molecular-weight component of the amorphous polyester resin can be lowered as compared with the case not having this constitution.

According to the invention, the SP value of the crystalline polyester resin can be relatively smaller than the SP value of the amorphous polyester resin, as compared with the case not having this constitution.

According to the invention, generation of filming on other members can be prevented as compared with the case not having this constitution.

According to the invention, generation of filming on other members can be prevented in image formation even under low-temperature fixation conditions, as compared with the case not having this constitution.

According to the invention, a toner for electrostatic image development capable of forming an image under low-temperature fixation conditions without generating filming on other members can be easily supplied and can improve the maintenance of the above characteristics.

According to the invention, an electrostatic image developer capable of forming an image under low-temperature fixation conditions without generating filming on other members can be easily handled and the compatibility thereof with an image forming apparatus with various constitutions can be improved.

According to the invention, formation of images without generation of filming on other members, even under low-temperature fixation conditions, can be maintained as compared with the case not having this constitution.

According to the invention, a toner for electrostatic image development capable of forming an image under low-temperature fixation conditions without generating filming on other members can be efficiently produced as compared with the case not having this constitution.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for electrostatic image development having a binder resin comprising an amorphous polyester resin and a crystalline polyester resin, and a coloring agent, and the binder resin satisfies the following relationship (1):

$$SP(L)>SP(H)>SP(C) \quad (1)$$

wherein

SP(H) is the solubility parameter of the binder resin contained in an elution fraction F (0-10) from the beginning of elution of W1 until 10% of the elution of W1 when W1 is the whole area of an elution curve on a gel permeation chromatograph measured for an acetone-soluble fraction of the toner;

SP(L) is the solubility parameter of the binder resin contained in an elution fraction F (80-100) from 80% to 100% of the elution of W1;

SP(C) is the solubility parameter of the crystalline polyester resin, the crystalline polyester resin has a weight-average molecular weight of from about 6,000 to about 35,000, and a melting point of from about 60° C. to about 120° C., a content of the crystalline polyester resin in the toner is from 15.7 wt % to 33.5 wt % based on a weight of the toner, the amorphous polyester resin comprises an amorphous polyester resin (1) having a weight-average molecular weight of from 8,000 to 25,000 and an amorphous polyester resin (2) having a weight-average molecular weight of from 30,000 to 200,000, the solubility parameter of the amorphous polyester resin (1) is larger than the solubility parameter of the amorphous polyester resin (2), and the toner is produced by an emulsification aggregation method.

2. The toner for electrostatic image development of claim 1, wherein the elution fraction F (0-10) comprises a component containing at least one of alkenylsuccinic acid and anhydrides thereof and at least one of trimellitic acid and anhydrides thereof reacted therein.

3. The toner for electrostatic image development of claim 1, which satisfies the following relationship (2):

$$0 \leq B < A \quad (2)$$

wherein A and B are the content (weight percentage), in the elution fractions F (0-10) and F (80-100) respectively, of a component containing at least one of alkenylsuccinic acid and anhydrides thereof reacted therein.

4. The toner for electrostatic image development of claim 1, wherein the crystalline polyester resin is an aliphatic crystalline polyester resin obtained by reacting a dicarboxylic acid having a carbon number of 10-12 with a diol having a carbon number of 4-9.

5. The toner for electrostatic image development of claim 4, wherein the content of the diol-derived component of the crystalline polyester resin is about 80 mol % or more.

6. The toner for electrostatic image development of claim 4, wherein the constituent ratio of an aliphatic polymerizable monomer included in the aliphatic crystalline polyester resin is about 60 mol % or more, wherein the constituent is an aliphatic diol or aliphatic dicarboxylic acid.

7. The toner for electrostatic image development of claim 1, wherein the toner comprises a release agent having a melting point of from about 50° C. to about 100° C.

8. The toner for electrostatic image development of claim 1, wherein the toner has a shape factor SF1 in the range of about 110 to about 140.

9. The toner for electrostatic image development of claim 1, wherein the toner comprises two or more external additives, and at least one of the external additives has a number-average primary particle diameter in the range of about 30 to about 200 nm.

10. An electrostatic image developer comprising the toner for electrostatic image development of claim 1.

11. The electrostatic image developer of claim 10, wherein the toner is mixed with resin coated carriers.

12. The electrostatic image developer of claim 10, wherein the toner is mixed with a resin dispersion carrier in which an electrically conductive material is dispersed in a matrix resin.

13. The toner for electrostatic image development of claim 1, wherein the amorphous polyester resin (1) and the amorphous polyester resin (2) are a combination of two resins selected from the group consisting of: resin (1) and resin (2); resin (3) and resin (4); resin (5) and resin (4); and resin (5) and resin (2), wherein resin (1) is the amorphous polyester resin (2), has a weight-average molecular weight of 45,000, and is included in a reaction product of 40 mol % of dimethyl terephthalate, 20 mol % of dimethyl fumarate, 35 mol % of dedecenyl succinic acid anhydride, 5 mol % of trimellitic acid anhydride, 10 mol % of bisphenol A-ethylene oxide, and 90 mol % of bisphenol A-propylene oxide, resin (2) is the amorphous polyester resin (1), has a weight average molecular weight of 14,000, and is included in a reaction product of 70 mol % of dimethyl terephthalate, 10 mol % of dimethyl fumarate, 25 mol % of dedecenyl succinic acid anhydride, 10 mol % of bisphenol A-ethylene oxide, and 90 mol % of bisphenol A-propylene oxide, resin (3) is the amorphous polyester resin (2), has a weight-average molecular weight of 38,000, and is included in a reaction product of 20 mol % of dimethyl terephthalate, 55 mol % of dimethyl fumarate, 25 mol % of dedecenyl succinic acid anhydride, 15 mol % of bisphenol A-ethylene oxide, and 85 mol % of bisphenol A-propylene oxide, resin (4) is the amorphous polyester resin (1), has a weight-average molecular weight of 12,000, and is included in a reaction product of 65 mol % of dimethyl terephthalate, 15 mol % of dimethyl fumarate, 20 mol % of dedecenyl succinic acid anhydride, 30 mol % of bisphenol A-ethylene oxide, and 70 mol % of bisphenol A-propylene oxide, and resin (5) is the amorphous polyester resin (2), has a weight-average molecular weight of 42,000, and is included in a reaction product of 25 mol % of dimethyl terephthalate, 50 mol % of dimethyl fumarate, 20 mol % of dedecenyl succinic acid anhydride, 5 mol % of trimellitic acid anhydride, 10 mol % of bisphenol A-ethylene oxide, and 90 mol % of bisphenol A-propylene oxide.

* * * * *